United States Patent [19]

Mourgue et al.

[11] Patent Number: 4,986,202

[45] Date of Patent: Jan. 22, 1991

[54] LIGHT DROPKEEL BOAT WITH SLIDING MEANS TO CONTROL THE TRANSVERSE BALANCE THEREOF

[75] Inventors: Pascal Mourgue; Patrice Hardy, both of Paris, France

[73] Assignee: Cartier International B.V., Amsterdam, Netherlands

[21] Appl. No.: 393,844

[22] Filed: Aug. 7, 1989

Related U.S. Application Data

[63] Continuation of Ser. No. 93,652, Sep. 8, 1987, abandoned.

[30] Foreign Application Priority Data

Sep. 8, 1986 [FR] France ..... 86 12543

[51] Int. Cl.[5] ..... B63B 39/02

[52] U.S. Cl. ..... 114/39.1; 114/124; 114/363

[58] Field of Search ..... 114/363, 39.1, 124; 297/344; 104/118

[56] References Cited

U.S. PATENT DOCUMENTS

| | | | |
|---|---|---|---|
| 2,756,711 | 7/1956 | Simpson | 114/39.1 |
| 3,417,720 | 12/1968 | Covell, Jr. | 114/124 X |
| 4,286,534 | 9/1981 | Sanner | 114/124 X |
| 4,432,525 | 2/1984 | Duvall | 114/363 X |

FOREIGN PATENT DOCUMENTS

| | | |
|---|---|---|
| 2559735 | 8/1985 | France . |
| 8104869 | 5/1983 | Netherlands . |

*Primary Examiner*—Sherman Basinger

*Attorney, Agent, or Firm*—Cushman, Darby & Cushman

[57] ABSTRACT

A light sailboat is provided with a transversely disposed sliding rail which extends from one side of the boat to the other. The sailboat is also provided with a seat which slides freely along this sliding rail.

16 Claims, 4 Drawing Sheets

14
18
17
15
16
19
20
28
12
25
13
21

18
14
15
19
33
20
36, 37
23
13
11
22
21
13A

LIGHT DROPKEEL BOAT WITH SLIDING MEANS TO CONTROL THE TRANSVERSE BALANCE THEREOF

This is a continuation of application No. 07/093,652, filed Sept. 8, 1987, which was abandoned upon the filing hereof.

The present invention relates to light dropkeel sailboats in which the transverse balance of the boat is controlled by the position and weight of at least one user.

BACKGROUND OF THE INVENTION

In fact, in this type of boat the crew which constitutes the ballast of the boat must constantly place itself in a good position to effectively assure the balance. To compensate for the heel, it must put itself as counter-balance by being, for example, at the gunwale in case of a monokeel boat construction. When the wind is very strong, this counter-balance must be increased by leaning outwardly while passing the feet through slings to stop the outward dipping of the boat; this corresponds to the action called return movement. Finally, in racing sailboats a crewman must put himself completely outside the cockpit with the help of a system known as a "trapeze".

SUMMARY OF THE INVENTION

The object of the present invention is an arrangement for the types of boats mentioned which offers the possibility of easily controlling the transverse balance while reducing the physical fatigue of the user(s).

Another object of the invention is a concomitant improvement in the safety of the boat.

Finally, it is in an aim of the invention to attain these results by suitable means for easing maintenance and transporting of the boat.

The arrangement proposed by the invention for this is mainly characterized by the fact that it comprises of at least one beam transversely disposed between the sides of the boat, which is adapted to form a sliding rail for at least one undercarriage supporting, preferably pivotably, a seat, the user being able to freely move said undercarriage on the sliding rail from one side to the other.

Because of this arrangement the user, seated on the sliding seat, can easily and without fatigue change his position on the transverse sliding rail by sliding his seat along the same and by modifying, in accordance with the requirements of the moment, the counter-balance action which is determined by the distance of the center of gravity of his body from the longitudinal axis of the boat.

The control of this action is advantageously facilitated by assuring that the seat-supporting undercarriage can ride practically without friction on the sliding rail.

In addition, the movements to shift sides are made more rapid by the use of a seat which pivots freely around a vertical axis of the undercarriage, so that the user does not need to make a half turn in respect to the seat at each side change and thus makes possible the use of a seat having a very anatomical form.

By means of another advantageous embodiment of the invention, the counter-balance action is aided by an elevation of the sliding rail in respect to the flotation system of the boat by means of portable structures.

In its application in connection with multi-hulled boats, the sliding rail(s) of the invention always play(s) the role of connecting structures between floats.

In connecting with multi-hulled boats the portable structures intended to elevate the sliding rail(s) of the invention are advantageously composed of vertical extensions of the volume of the hull of the floats.

This preferred construction embodiment of the invention offers the great advantage of also creating an additional reserve of floatability which increases the safety of the boat.

The characteristics and advantages of the invention will become apparent by means of the description of an exemplary embodiment in connection with the drawings.

DETAILED DESCRIPTION

Figure 1:
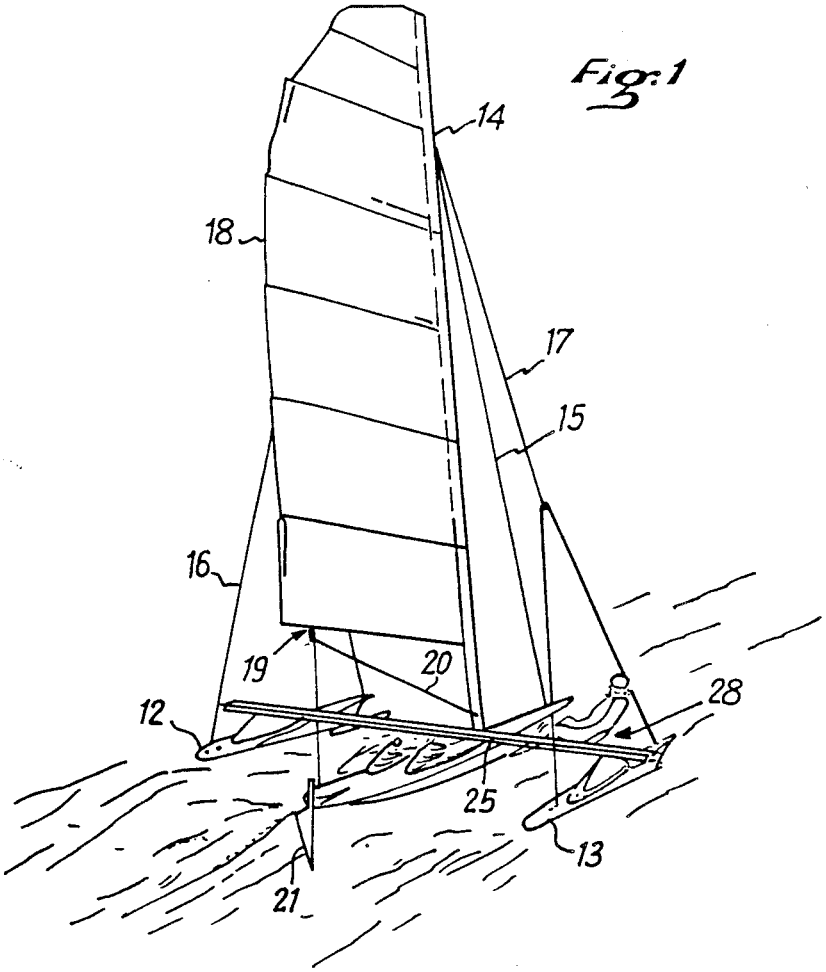
FIG. 1 is a perspective view of a single-seater trimaran in accordance with the invention.
Figure 2:
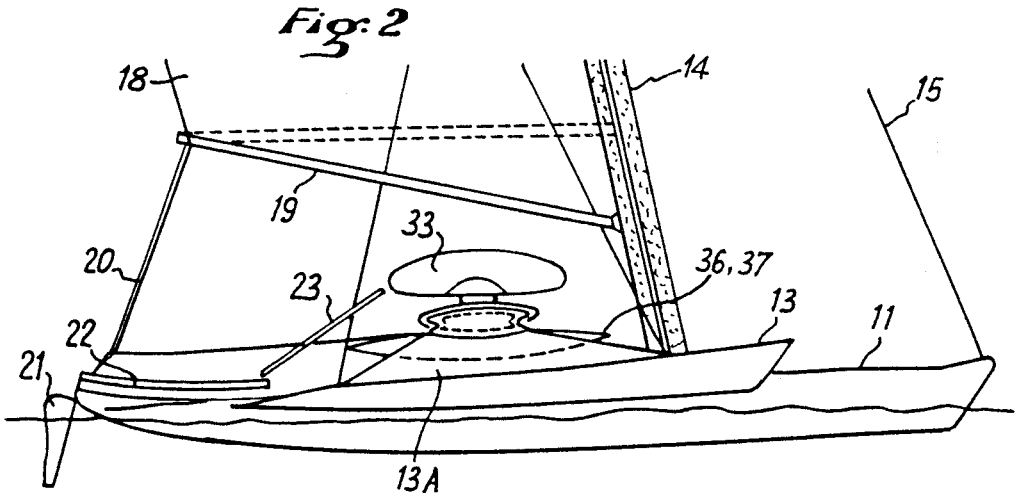
FIG. 2 is a partial elevated view of FIG. 1.
Figure 3:
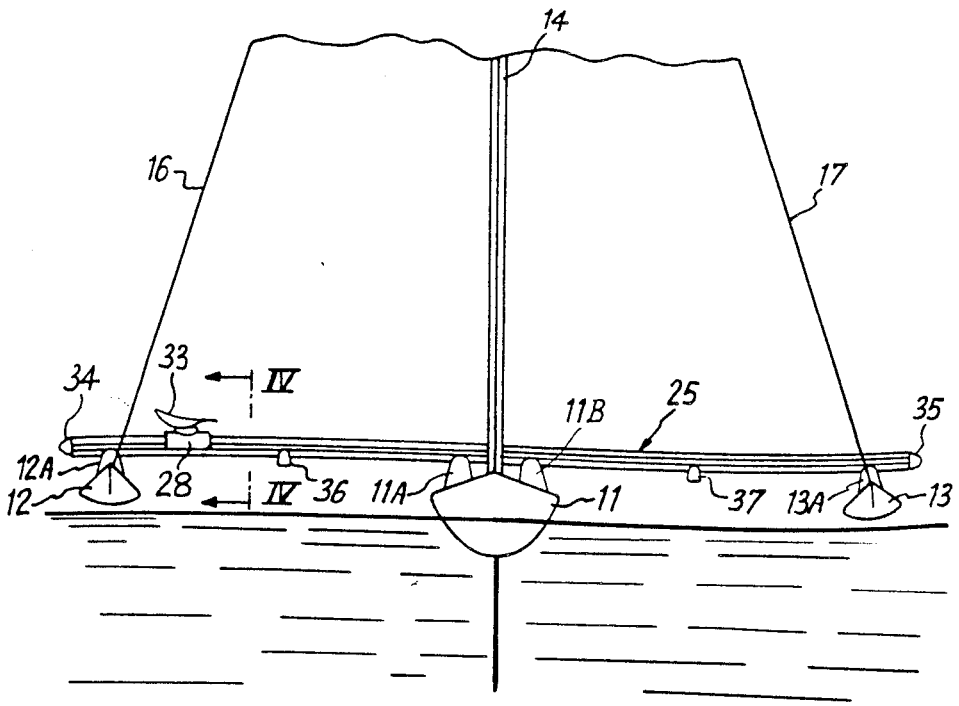
FIG. 3 is a front view of the boat of FIGS. 1 and 2.

In accordance with the embodiment shown, the invention is applied to a light trimaran having a flotation system comprising a central hull 11 and two lateral hulls 12 and 13. A mast 14, the foot of which is inserted in a step of the central hull, is supported in a known manner by a stay 15 and two bracing wires 16 and 17, respectively fastened to port and starboard floats 12 and 13, respectively.

The drawing schematically shows a main sail is 18 with a boom 19 and main sheet 20. The jib sail is not shown by can always be provided, along with its corresponding main sheet.

Also shown in the drawing is a rudder placed in a known manner at the rear of the main float and comprising an afterpiece 21 and a tiller 22 with a stick 23.

Figure 4:
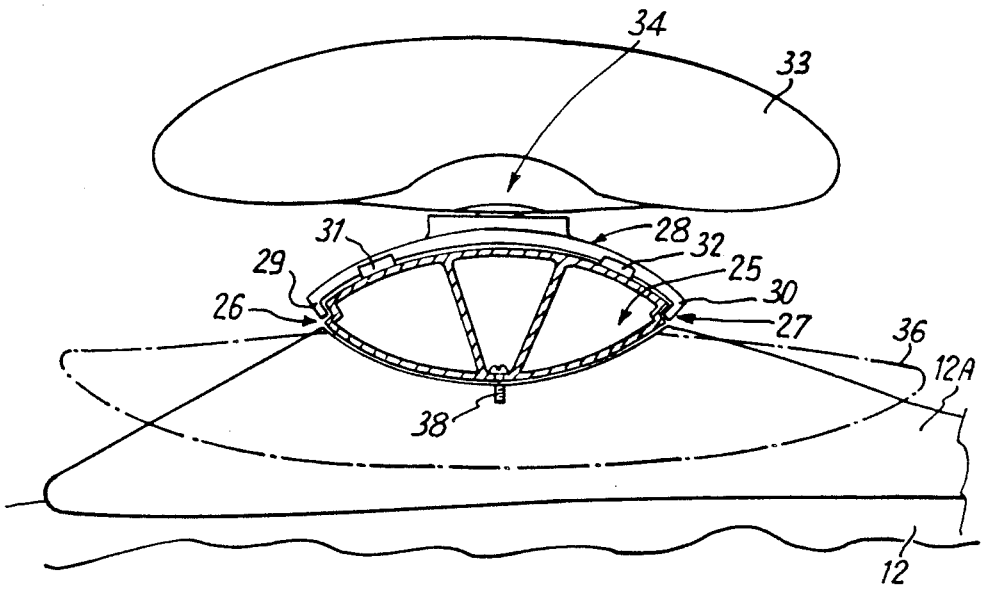
FIG. 4 is a much larger scale view along the line IV—IV of FIG. 3.

According to a preferred embodiment of the invention a transverse connecting sliding rail 25 has a double convex ovoidal profile, visible in section in FIG. 4, and is provided with two lateral grooves 26 and 27.

In accordance with the invention this sliding rail 25 extends transversely from one side of the boat to the other and thus allows the user to place his seat in the described position to assure the counter-balance action required by the force of the wind and the trim of the boat.

The lower convex face of the sliding rail 25 is adapted to be received by interlocking with the extensions 12A and 13A recessed for the purpose in the lateral floats 12 and 13, as well as with two vertical extensions 11A and 11B provided projecting upwardly from the deck of the central hull 11 on both ends of its mediam longitudinal plane.

The convex upper face of the sliding rail 25 which is thus elevated in respect to the flotation system supports an undercarriage 28, the shoulder of which takes the form of the said upper convex face of the sliding rail 25.

Interdependent retaining means 29 and 30 of the shoulder of the undercarriage of the seat support engage with the lateral grooves 26 and 27 such that they link the undercarriage with the sliding rail and prevent the undercarriage from disengaging itself from the latter during movement.

The lower face of the shoulder of the undercarriage is furthermore advantageously equipped with rollers 31, 32 adapted for rolling on the beam.

A seat 33 is pivotally mounted on the undercarriage by means of a bearing 34 with a vertical axis. Seat 33 may be made large enough to serve as a double seat for two crew members.

The beam 25 is provided at each of its end with ferrules 34, 35 which serve at the same time as stops for the undercarriage 28 and as protection against blows. The ferrules can also be advantageously adapted to serve as carrying handles for the boat.

The lower convex face of the sliding rail 25 is equipped with foot rests 36, 37 located, for example, at midpoint between the central hull 11 and the lateral hulls 12, 13.

As shown in FIG. 4, these foot rests are advantageously made in the shape of two bars extending from either end of the sliding rail which support them with its lower convex face.

Installation of the foot rests on the beam can be made by means of bolts such as the ones shown in FIG. 4 by reference numeral 38.

Figure 5:
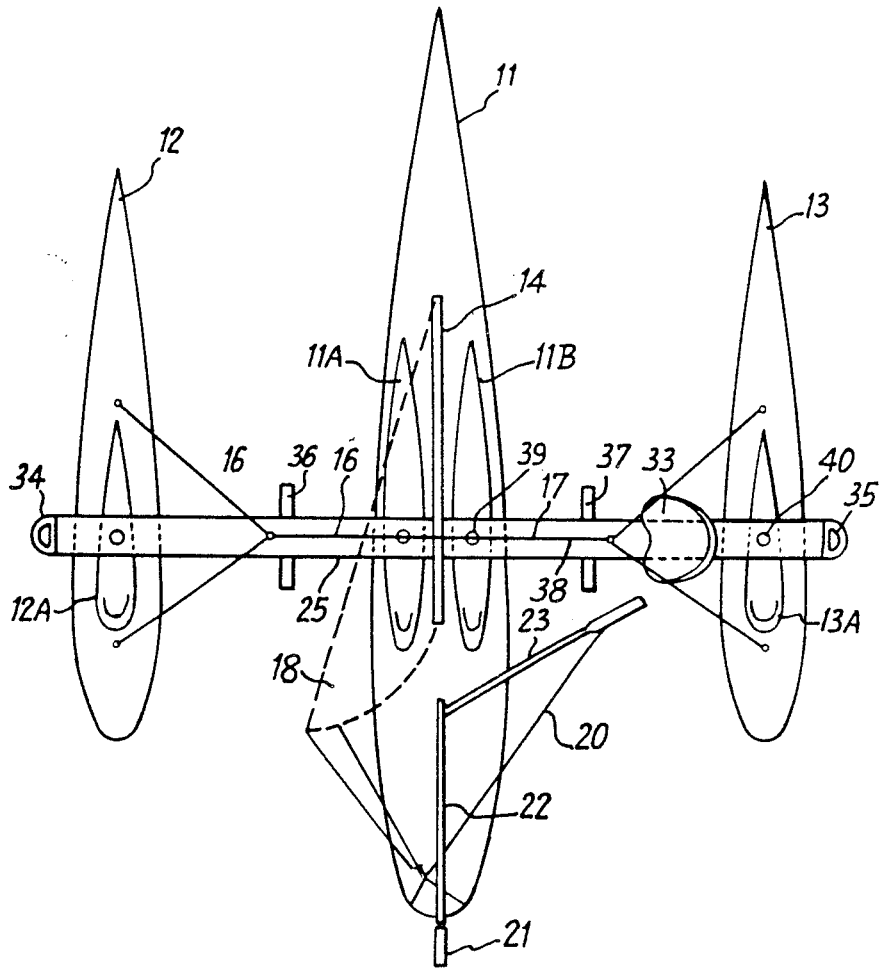
FIG. 5 is a schematic view from below corresponding to FIG. 1.

Fastening of the sliding rail 25 on the hulls is always done by means of screws 39, 40 (FIG. 5) which engage in the concave recesses made in the tops of the extensions 11A, 11B on the one side and 12A, 13A on the other for receiving the sliding rail 25.

It is thus seen that the flotation system can easily and rapidly be assembled and disassembled and that, once assembled and rigged, the boat can easily be carried by two people by means of the carrying handles provided at the ferrules 34, 35.

According to the invention the seat 33 gliding freely on the sliding rail 25 permits the user seated on it to control in a particularly precise, rapid and efficient manner the lateral balance of the boat, always leaving his hands free for controlling the bar and the main sheet(s).

In fact, once seated on the seat 33 with his feet supported on the mail hull 11 (or on an extension 11A or 11B thereof), the user can, by means of a simple action of his limbs, extend himself progessively or rapidly along the axis of the boat as far as passing over the foot rests 36 or 37, then by again supporting himself on the latter, continue to displace himself outside the boat so that he is perpendicular to the lateral float or even with it, the limit of the displacement being determined by the position of the ends of the ferrules 34, 35 placed on the ends of the sliding rail 25.

Because of the fact that the undercarriage moves freely along the sliding beam and because of the pivotable installation of the seat on the undercarriage, the movements in case of the veering of the sides or any other changes of the trim of the boat can be made very rapidly and the counter-balance can always be controlled with precision in response to the circumstances.

The usefulness of the device is also augmented by the raised position of the sliding rail 25. The extensions 11A, 11B, 12A and 13A which make this elevation possible offer, in fact, the advantage of providing a flotation reserve from which an improvement in the safety of the boat results.

In the case of the embodiment described by virtue of the example, the trimaran with a length of 420 centimeters comprises a central hull of 350 liters and two lateral floats of 50 liters each.

The extensions 11A and 11B of the central hull have a total volume of approximately 120 liters and each of the extensions 12A and 13A of the lateral floats has a volume of approximately 20 liters.

In a general way it is advantageous to provide extensions with a total volume of between a third to one half of the total volume of the conventional flotation system.

The extension are advantageously provided in the form of hulls molded at the same time as the deck of the hull and the floats.

In accordance with another embodiment of the invention the extensions can be provided separately and later assembled in any manner appropriate with the conventional floats of the prior art.

In any case the boat can still be dismantled easily and rapidly, which makes its maintenance and transport easier.

It is to be understood that the invention is not limited to the embodiment described herein.

Figure 6:
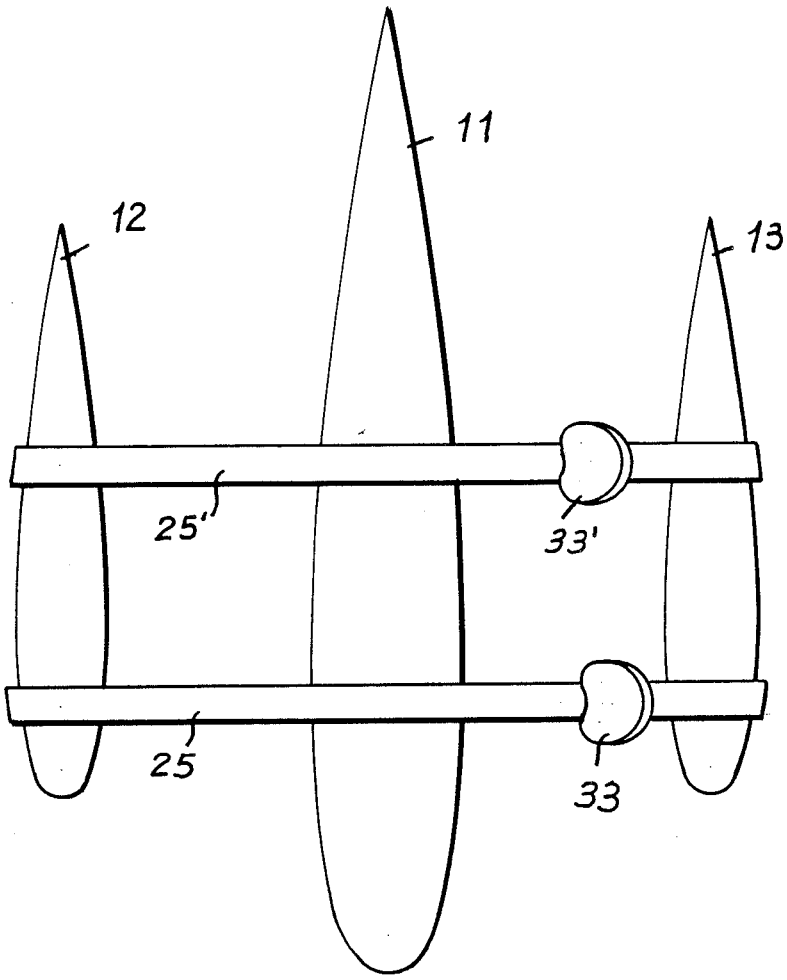
FIG. 6 shows a trimaran sailboat comprising two sliding beams.

Thus it is also possible to provide two seats for two crew members; these two seats can be disposed on one undercarriage or can also be placed on individual undercarriages, using two separate transverse beams provided at two locations appropriately chosen along the length of the boat as shown in FIG. 6.

In the last type of embodiment each seat can be occupied by one crew member, the counter-balance can be produced by either one or the other or by both at the same time, depending on the circumstances.

An embodiment with two transverse beams with or without one sliding seat one each one can also be provided in a particularly advantageous manner by use of the invention in connection with catamarans, because it provides a coherent flotation system and claims optimal use for two crew members.

In connection with boats of monohull construction the sliding rail according to the invention can be installed on appropriately adapted supports to assure a reasonable elevation in relation to the gunwale of the boat and with an overhand on either side of the latter which in general is limited to approximately one meter.

The support system adapted for each particular type of boat of monohull construction may possibly comprise an adjusting means on its position in a longitudinal direction.

What is claimed is:

1. A light sailboat in which a seat for a crew member can be freely laterally displaced relative to the boat for balancing the same against the action of the wind, said sailboat comprising:

a slide beam fixed transversely across the sailboat and extending continuously from at least one outer side of the sailboat to the other outer side, a carriage movably mounted on said slide beam for movement from one end of said slide beam to the other end and a seat pivotally mounted about a generally vertical axis on said carriage.

2. The sailboat of claim 1 wherein the slide beam is supported by a plurality of hulls or floats by means of extensions which increase the useful volume of the said hulls or floats.

3. A trimaran boat in accordance with claim 2 comprising a central hull and two lateral floats wherein said slide beam is supported by two extensions located symmetrically on either side of the medium longitudinal plane of the central hull.

4. A trimaran in accordance with claim 2 or 3 in which said extensions have a volume comprised between one third and one half of the volume of said hulls or floats.

5. The sailboat of claim 1 which includes foot rests disposed laterally and under the path of said carriage on said slide beam.

6. The sailboat of claim 1 wherein the slide beam has an ovoidal section defined by an upper convex face and a lower convex face, the two faces being connected by their lateral sides.

7. The sailboat of claim 6 wherein the slide beam comprises lateral guide grooves.

8. The sailboat of claim 7 wherein the carriage comprises retention means engaging the guide grooves.

9. The sailboat of claim 6 wherein the underface of the carriage has a concave shape corresponding to the convex shape of the upper face of said slide beam.

10. The sailboat of claim 1 wherein the sliding beam (25) is rectangular.

11. The sailboat of claim 1 wherein the sliding beam is provided at each of its ends with a protective ferrule equipped with handles.

12. The sailboat of claim 1 wherein the sliding beam comprises stops delimiting the extent of movement of the carriage bearing the seat.

13. The sailboat of claim 1 comprising a plurality of slide beams, each equipped with its own seat.

14. The sailboat of claim 1 wherein the seat is a double seat capable of supporting two crew members.

15. The sailboat of claim 1 wherein the carriage is provided with a lower surface comprising rollers adapted to roll on the slide beam.

16. A light sailboat in which a seat for a crew member can be laterally displaced relative to the boat for balancing the same against the action of the wind, said sailboat comprising:

a slide beam fixed transversely across the sailboat and extending continuously from at least one side of the sailboat to the other, a carriage movable mounted on said slide beam for movement from one end of said slide beam to the other end and a seat pivotally mounted about a generally vertical axes on said carriage, said slide beam being supported by a plurality of hulls or floats by means of extensions which increase the useful volume of said hulls or floats.

* * * * *